US006438977B1

(12) United States Patent
McKay

(10) Patent No.: US 6,438,977 B1
(45) Date of Patent: Aug. 27, 2002

(54) AIR CONDITIONER COOLING APPARATUS

(76) Inventor: Richard Duncan McKay, 1276 Lynnmere Dr., Thousand Oaks, CA (US) 91360

( * ) Notice: Subject to any disclaimer, the term of this patent is extended or adjusted under 35 U.S.C. 154(b) by 0 days.

(21) Appl. No.: 09/895,740

(22) Filed: Jul. 2, 2001

(51) Int. Cl.[7] ..... F28D 3/00
(52) U.S. Cl. ..... 62/171; 62/305
(58) Field of Search ..... 62/171, 305

(56) References Cited

U.S. PATENT DOCUMENTS

| | | | | |
|---|---|---|---|---|
| 3,613,392 A | * | 10/1971 | Tucci | 62/171 |
| 4,240,265 A | * | 12/1980 | Faxon | 62/171 |
| 4,274,266 A | | 6/1981 | Shires | |
| 4,351,163 A | * | 9/1982 | Johannsen | 62/305 |
| 4,542,627 A | * | 9/1985 | Welker | 62/171 |
| 4,685,308 A | * | 8/1987 | Welker et al. | 62/171 |
| 5,285,651 A | * | 2/1994 | Marine | 62/171 |
| 5,605,052 A | | 2/1997 | Middleton et al. | |
| 6,105,376 A | | 8/2000 | Stewart et al. | |

* cited by examiner

*Primary Examiner*—William C. Doerrler
(74) *Attorney, Agent, or Firm*—Jack C. Munro

(57) ABSTRACT

An air conditioner cooling apparatus which is designed to be used in conjunction with a cabinet type air conditioner that has an air exhaust portal which has an exhaust airflow,path and a length of condenser coils. The cooling apparatus comprises a paddle which is to be placed within the exhaust airflow path and upon operation of the air conditioner, the paddle is to be pivoted from a crosswise position relative to the airflow path to an inclined position relative to the airflow path. The pivoting of the paddle connects by a linkage assembly to a control arm with this control arm to be raised from a lower position to an upper position when the air conditioner is activated. The control arm connects to a water supply valve which is opened when the air conditioner is turned on with water to be caused to flow through the valve to a series of discharge nozzles with this water to be dispensed onto the condenser coils of the air conditioner.

5 Claims, 3 Drawing Sheets

AIR CONDITIONER COOLING APPARATUS

BACKGROUND OF THE INVENTION

1. Field of the Invention

This invention relates to air conditioners and more particularly to an apparatus which causes water to be dispensed onto the condenser coils of the air conditioner in order to promote faster heat exchange therefrom with the dispensing of the water being activated solely upon the operation of the air conditioner with the operation of the cooling apparatus being achieved mechanically, not electrically.

2. Description of the Related Art

There are many different types of air conditioners with one common type being a refrigerated type of air conditioner that resembles a cabinet which is frequently installed within residential homes, offices and industrial buildings. These cabinet types of air conditioners are generally connected to a central heating and air conditioning system of the house or building. These types of air conditioners include a compressor unit which works in conjunction with a pump and condenser coils. A heat absorbing fluid is conducted through the coils and by its expansion and contraction functions to remove heat from within the house or building. This collected heat is then discharged into ambient air exteriorly of the house or building with this heat to be dissipated through the condenser coils. In order to facilitate this transfer of heat, there is utilized an electrically operated fan which is to move air across the condenser coils.

It long been known that one can increase the efficiency of the air conditioner by misting or spraying of water on the coils. This application of water on the coils promotes faster heat exchange from the condenser coils to the ambient. This increased efficiency usually results in a few extra degrees of cooling for the house or building at the same time decreasing the load on the compressor of the air conditioner. In situations where there is exceedingly hot weather, this difference can amount to the cooling of the air space within the house or building to a comfortable temperature as opposed to an uncomfortable temperature while minimizing the load being encountered by the air conditioner.

The application of the water onto the condenser coils cools the condenser coils and the fluid contained within the coils thus reducing the pressure of the fluid. The compressor encounters less back pressure and thus consumes less energy. The cooler fluid results in a lower temperature at the evaporator coil inside the house or building and therefore the air conditioner operates for a shorter period of time in order to cool the interior space to the desired temperature. In the past, the controlling of the delivery of water onto the condenser coils is well known. However, for some reason, the prior art systems have failed to appear in the marketplace. The failure of the prior art systems to achieve widespread success may be attributed to any number of shortcomings associated with the previous designs. One of the problems of previous designs is that under high water pressure many valves become inoperable, in other words the valve may not close. Also, prior art designs were frequently complicated using pressure regulators, specialized valves, large and heavy vanes, paddles or air cups on the end of long support arms. Any air conditioner cooling apparatus should be simple, low cost, easily adaptable to the wide variety of different types of air conditioners that are on the market, adaptable to the many different household water pressures, adaptable to the different rates of airflow in the various models of air conditioners, and easy to install and remove. The air conditioning cooling apparatus should also minimize the degree of obstruction of the airflow of the exhaust airflow path of the air conditioner in order to minimize the flow of air and increase the overall operating efficiency of the air conditioner.

SUMMARY OF THE INVENTION

The basic structure of the present invention comprises an air conditioner cooling apparatus to be used in conjunction with a cabinet type air conditioner that has an air exhaust portal which has an exhaust airflow path and a length of condenser coils. A paddle is to be mounted and located within the exhaust airflow path. A normally closed water supply valve is connected to a source of pressurized water. Opening of the water supply valve causes water to be supplied to a series of discharge nozzles through which water is to be dispensed onto the condenser coils. A control arm connects to the valve and extends outwardly therefrom. Movement of the control arm from a lower position to an upper position will cause the valve to move from a closed position to an open position permitting flow of water to the discharge nozzles. A linkage assembly connects the paddle to the control arm. As the paddle is moved by the exhaust airflow path from a crosswise position within the airflow path to an inclined position, the control arm is to be moved by the linkage assembly from its lower position to the upper position and hence opening of the valve.

Another embodiment of this invention is where the control arm within the basic embodiment is designed to pivot relative to the valve.

In another embodiment of this invention, the basic embodiment is modified by the paddle being permitted to pivot from the crosswise position within the airflow path to the inclined position.

In another embodiment of this invention, the basic embodiment is modified where the linkage assembly includes a roller mounted on the control arm with a cam, which connects to the paddle, riding on the roller.

In another embodiment of this invention, the basic embodiment utilizes a roller that is adjustable by raising and lowering of the roller relative to the control arm.

In another embodiment of this invention, the basic embodiment is modified with the control arm including a weight assembly with this weight assembly to be adjustable on the control arm to vary the amount of force being applied to maintain the valve in the closed position.

In another embodiment of this invention, the just previous embodiment is modified by the weight assembly of the control arm being adjustable by increasing or decreasing the spacing of the weight assembly relative to the valve.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
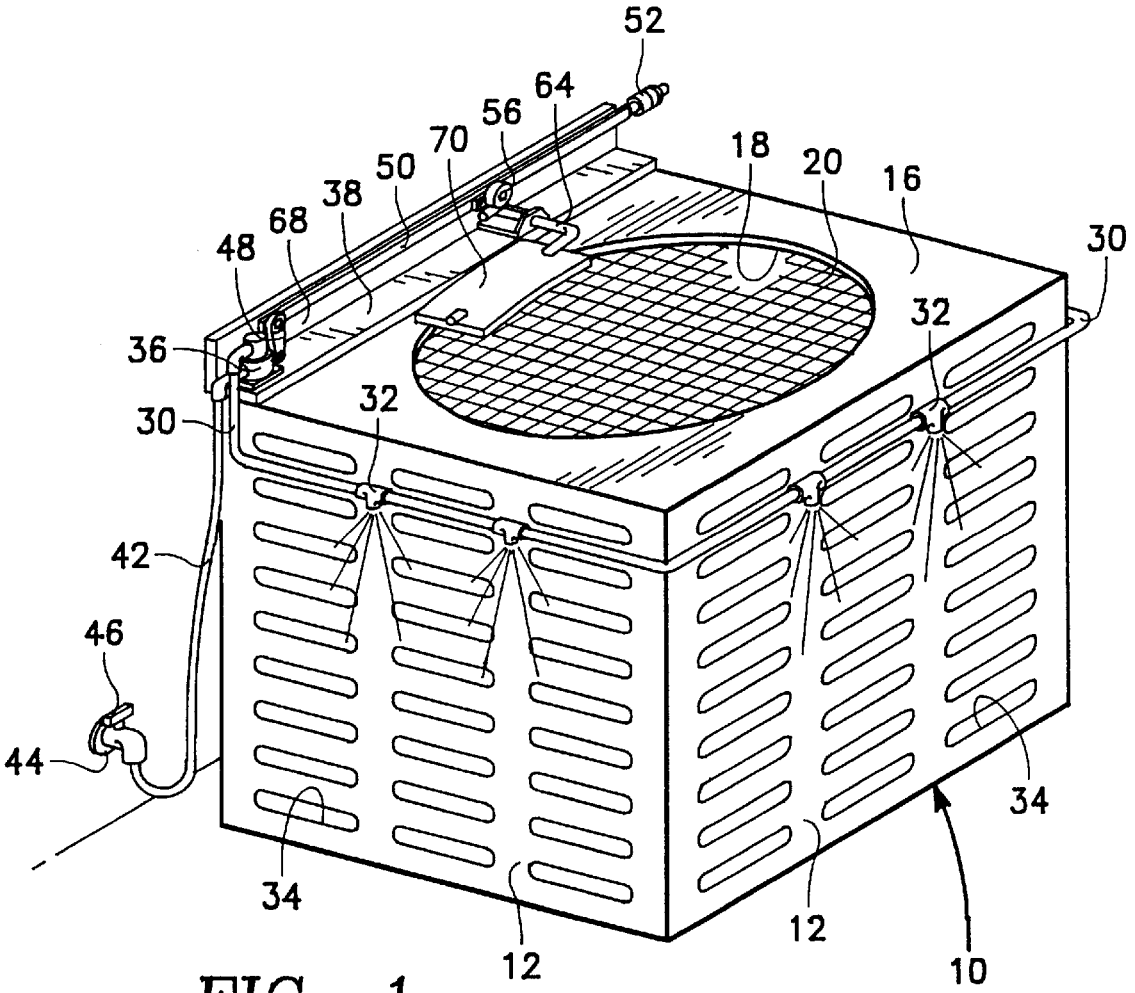
FIG. 1 is an exterior isometric view of a typical cabinet type of air conditioner on which has been installed a first embodiment of air conditioner cooling apparatus of the present invention.
Figure 4:
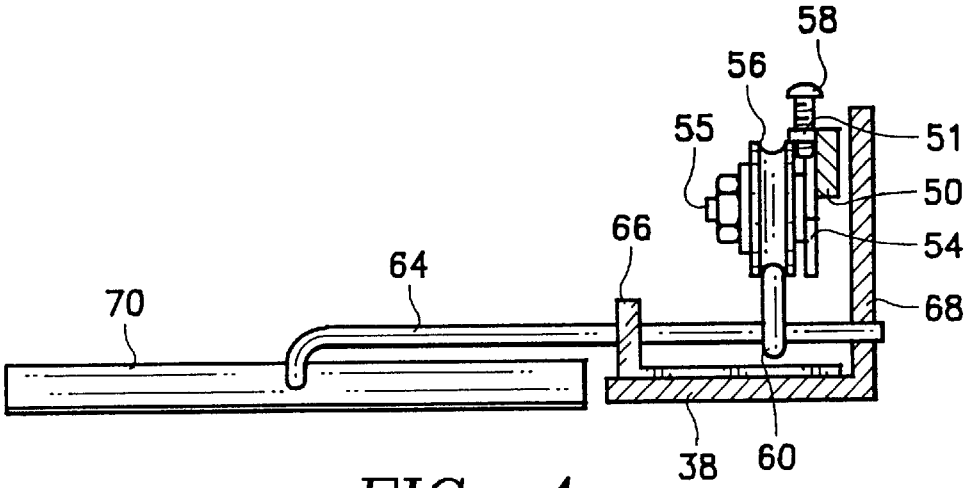
FIG. 4 is a view partly in cross-section through the air conditioner cooling apparatus of the present invention taken along line 4—4 of FIG. 2.

Referring particularly to the drawings, there is shown a cabinet type of air conditioner 10 that has a series of louvered side panels 12. Mounted interiorly of the side panels 12 are a series of condenser coils 14. Generally, these condenser coils 14 are arranged in a back and forth serpentine manner with the coils 14 constituting a continuous flow path. Through the coils 14 is to be conducted a fluid, which is not shown. A typical fluid is what is commonly sold under the trade name Freon.

The cabinet air conditioner 10 includes a top panel 16 that includes an enlarged circular hole 18. Within the top panel 16, the enlarged circular hole 18 is covered by a mesh screen 20. Mounted within the interior cabinet 10 and located directly adjacent the interior surface of the mesh screen 20 is a fan blade 22. The fan blade 22 is to be rotated from a motor (not shown) which causes rotation of shaft 24 upon which the fan blade 22 is mounted. Rotation of the fan blade 22 causes air to be conducted from the ambient inwardly across the condenser coils 40 to within the interior of the cabinet air conditioner 10. This air is then moved through an exhaust flow path represented by arrows 26 and 28 through the mesh screen 20 to within the ambient.

Mounted about the cabinet air conditioner 10 is a dispensing tube 30. The dispensing tube 30 includes two in number of discharge nozzles 32 for each side panel 12 with it being understood that there will also be two discharge channels for the side panel, which is not shown. The discharge nozzles 32 are normally designed to emit mist rather than a stream with this mist to be conducted through the louvers 34 into contact with the condenser coils 14. The discharge tube 30 is connected to a valve housing 36 with this valve housing 36 being mounted on an L-shaped mounting plate 38 of the first embodiment of this invention.

Figure 2:
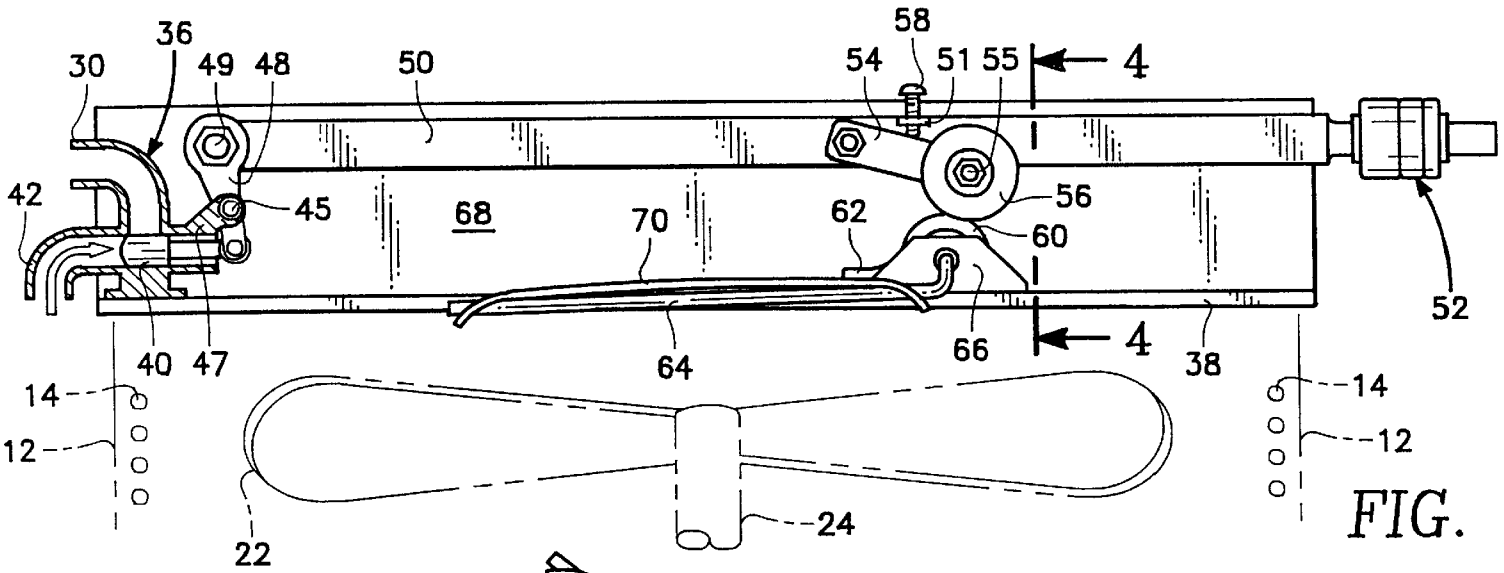
FIG. 2 is a front view of the mechanism of the air conditioner cooling apparatus of the present invention showing the first embodiment of air conditioner cooling apparatus in its non-operated position not causing any water to flow onto the condenser coils of the air conditioner.

This L-shaped mounting plate 38 is to be fixedly mounted onto the top panel 16. The valve housing 36 includes a valve piston 40. The valve piston 40 is to be movable from a retracted position, shown in FIG. 2, to an extended position, shown in FIG. 3, and when in the retracted position, discharge tube 30 is closed by the valve piston 40. Also, valve piston 40 will close off water supply tube 42 which is to be connected to a water supply spigot 44 which will normally be mounted in conjunction with the house or building, which is not shown. The water supply spigot 44 also includes a valve, which is not shown, with the valve in the spigot 44 to be normally positioned by the valve spindle 46 being located so that pressurized water will be continuously supplied within the water supply tube 42. However, no flow of the water from the water supply tube 42 into the water discharge tube is permitted when the valve piston 40 is in the closed position, as shown in FIG. 2.

The valve piston 40 is pivotally connected to a link 48. The link 48 is pivotally connected by pin 49 to a control arm 50. Link 48 is pivotally connected by pivot pin 45 to arm 47 which is integral with valve housing 36. The control arm 50 is shown to be of elongated configuration and has a rectangular cross-sectional configuration. However, it is to be considered to be within the scope of this invention that control arm 50 may assume the configuration of a rod. The inner end of the control arm 50 is attached to the link 48 and at the outer end of the control arm 50 there is mounted, thereon, a series of weights 52. Normally, there will be a four ounce weight, a two ounce weight and a one ounce weight forming the series of weights 52. The weights 52 are to be adjustable longitudinally on the control arm 50 or one or more of the weights could be actually removed from the control arm 50. The weights 52 are to be used so that when the water pressure that is supplied to the valve piston 40, that just the right amount of weight is used on the control arm 50 so the valve piston 40 will be moved to the closed position, as shown in FIG. 2, when the airflow has been turned off with the fan 22 non-operating. It is to be understood that within some homes or businesses that the water supply tube 42 may contain a higher or lower pressure of water. Therefore, weights 52, by adjusting of such relative to the control arm 50 can precisely individually control the shutting off of the valve piston 40 according to the specific requirements of the particular installation.

Mounted on the control arm 50 is a link 54 located intermediate the weights 52 and the link 48. The link 54 has an outer end which has mounted thereon by a pin 55 a roller 56. Mounted on a tab 51 of the control arm 50 is an adjustment screw 58. The adjustment screw 58 can be tightened or loosened in order to vary the position of the roller 56 relative to the control arm 50. The use of the adjustment screw 58 is so as to again provide for individual adjustment for the particular air conditioner on which the air conditioning cooling apparatus of this invention has been installed. The position of the roller 56 is to be set so that when the roller 56 rests on cam 60, and there is no airflow being created by the fan blade 22, that the valve piston 40 will be in the closed position, as shown in FIG. 2.

The cam 60 constitutes an arcuate shaped rod which has an outer flared end 62. When the roller 56 connects with the outer flared end 62, the outer flared end 62 functions as a stop not permitting any further clockwise rotational movement of the cam 60. The cam 60 is integrally connected to a pivot rod 64. This pivot rod 64 is low frictionally mounted between upstanding mount 66 and back plate 68 of the L-shaped mounting plate 38. Pivot rod 64 is connected to a flat plate configuration of a paddle 70. The paddle 70 is designed to be located in contact with the mesh screen 20, or in close proximity thereto. The paddle 70 is to be pivoted from a crosswise position to the airflow path, shown in FIG. 2, to an inclined position (substantially forty-five degrees) to the airflow path, shown in FIG. 3. The pivot rod 64 pivots relative to the upstanding mount 66 and the back plate 68.

When the paddle 70 moves from the crosswise position to the inclined position, roller 56 will ride on the cam 60 to come into engagement with the outer flared end 62. During this time, the control arm 50 is pivoted from a lower position to an upper position with the upper position shown in FIG. 3 and the lower position being shown in FIG. 2. This results in the valve piston 40 being moved from the retracted position, shown in FIG. 2, to the extended position, shown in FIG. 3, which will permit water to flow from the water supply tube 42 into the discharge tube 30. The water within the discharge tube 30 will then be dispensed through the series of discharge nozzles 32 into contact with the condenser coils 14.

Figure 3:
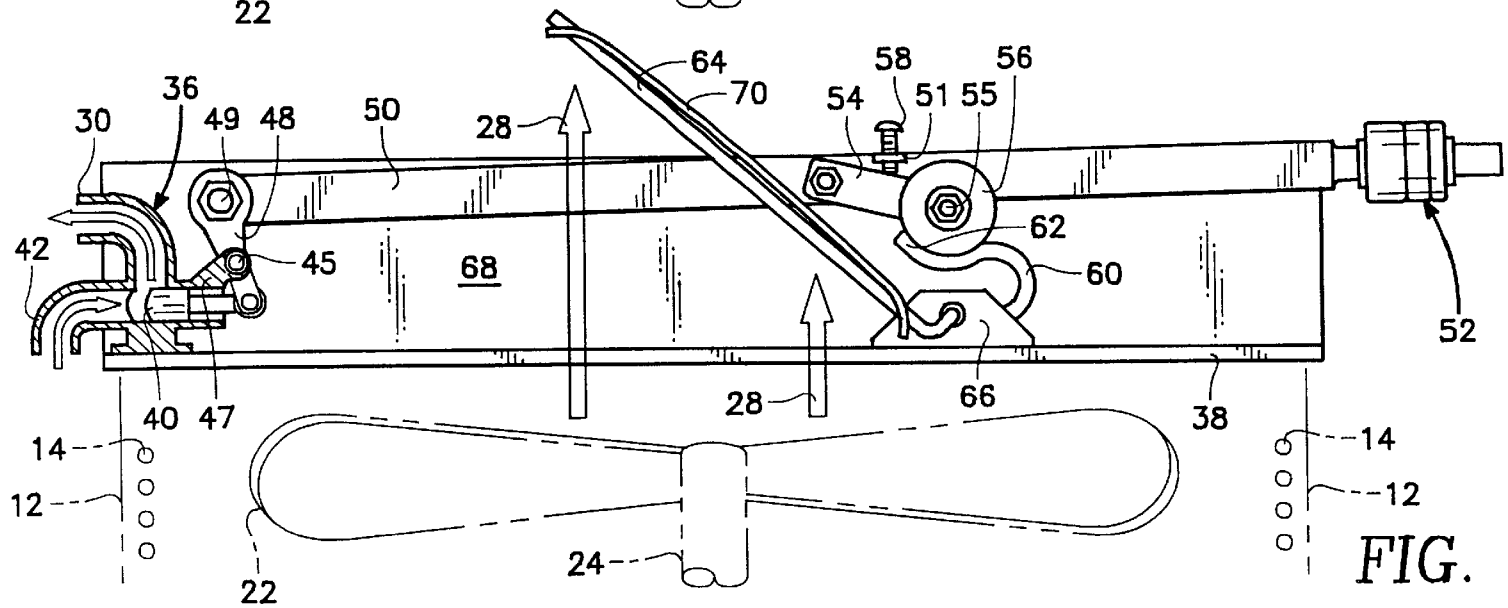
FIG. 3 is a view similar to FIG. 2 but showing the apparatus in the operated position where water is flowing onto the condenser coils of the air conditioner.

It is to be understood that when the fan blade 22 is no longer rotating and the airflow terminates, that the paddle 70 will automatically pivot again to the crosswise position, shown in FIG. 3, and the control arm 50 will then move to the lower position and valve piston 40 will then move to the retracted position preventing flow of water from the water supply tube 42 into the discharge tube 30.

Figure 5:
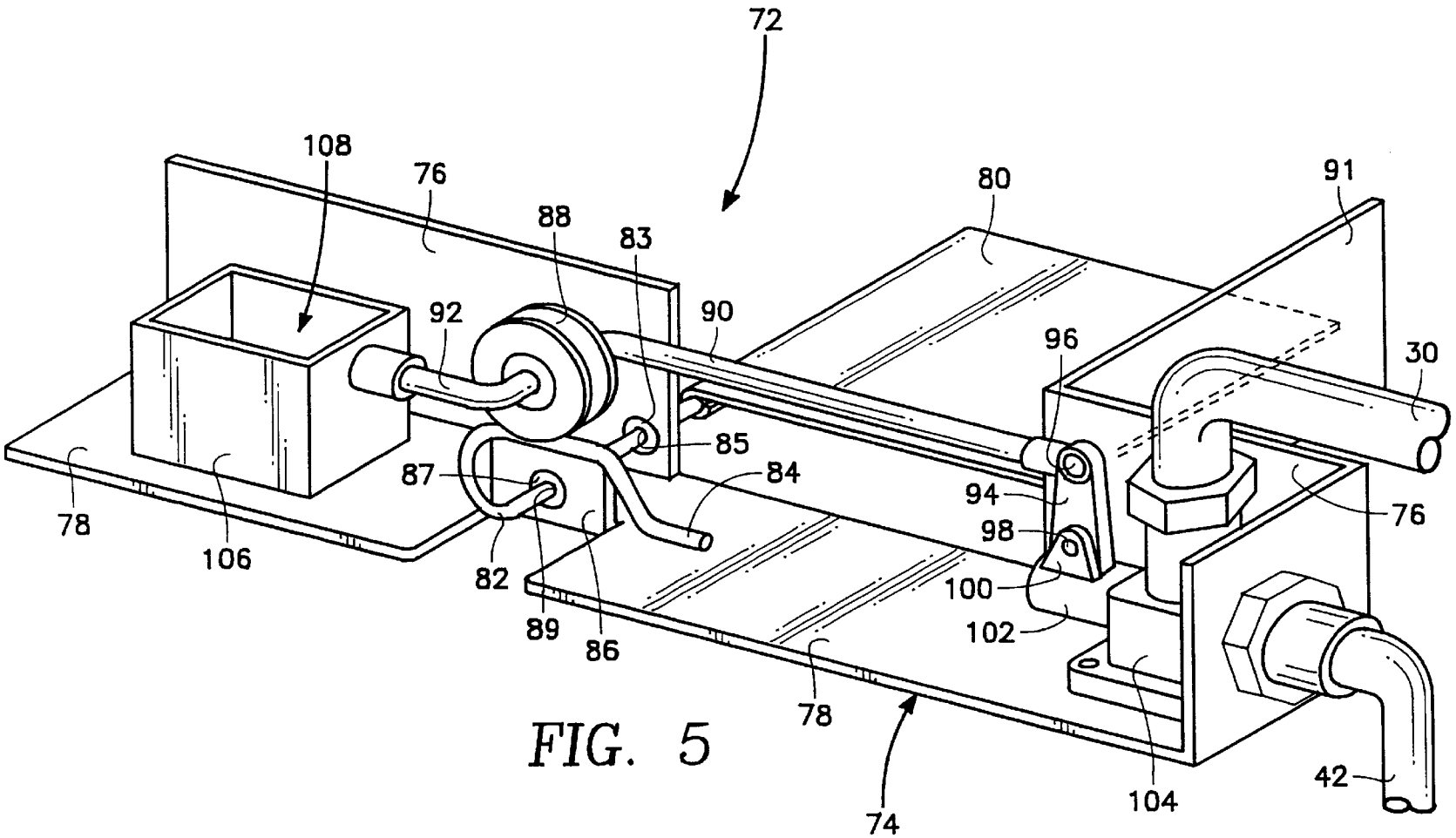
FIG. 5 is an exterior isometric view of a second embodiment of air conditioning cooling apparatus that is intended to be mounted in conjunction with a typical type of cabinet air conditioner.

Referring particularly to FIG. 5, there is shown the second embodiment 72 of air conditioner cooling apparatus of this invention. Second embodiment 72 operates similarly to the first embodiment in that there is utilized an L-shaped mounting plate 74 which also has a back plate 76 which is mounted at a right angle to a baseplate 78 of the L-shaped mounting plate 74. The paddle 80, which is essentially identical to paddle 70, is mounted on a pivot rod 82 which is similar to pivot rod 64. The pivot rod 82 also has an outer flared end 84 which is similar and functions for the same purpose as the outer end 62 of the first embodiment. The pivot rod 82 is pivotally mounted by a grommet 83 mounted within a hole 85 formed in the back plate 76 and also is pivotally mounted by a grommet 87 mounted within a hole 89 mounted in a short plate 86 which is mounted at a right angle to the baseplate 78. The pivot rod 82 is designed to come into connection with a roller 88 which is essentially identical to roller 56. The roller 88 is low frictionally mounted on a bend 92 of the control arm 90. The control arm 90 has a circular cross section which is different from the rectangular shaped cross-section of the control arm 50.

The inner end of the control arm 90 is fixedly mounted to a link 94. The link 94 and the control arm 90 are pivotable by pivot pin 96 which is fixed onto a portion of the back plate 76. The outer end of the link 94 is pivotally mounted by a pivot pin 98 which in turn is fixed to an arm 100. Arm 100 is connected to a valve piston, not shown. The valve piston of the second embodiment will be basically similar to the valve piston 40 of the first embodiment. The valve piston is mounted within valve housing 104. Connecting with the valve housing 104 is the water supply tube 42 and the dispensing tube 30. The outer end of the control arm 90 is fixed to a container 106. The container 106 is basically a box that has an open top.

The second embodiment 72 will operate in precisely the same manner as the first embodiment. When the paddle 80 is pivoted to an inclined position by the airflow passing through enlarged circular hole 18, the roller 88 will be moved in an upward direction raising container 106 relative to the baseplate 78. The air guide plate 91 functions to confine the air in the area of paddle 80 producing a "tunnel" affect which will maximize the pivoting of the paddle 80 to the greatest inclined position. At the same time, the link 94 will be pivoted causing outward movement of the valve piston shaft 102 relative to the valve housing 104. This will cause the valve piston to be unseated and flow of liquid to occur into dispensing tube 30. When the airflow through the enlarged circular hole is terminated, the paddle 80 will again move to the lower position, as shown in FIG. 5. The control arm 90 and roller 88 should then fall by gravity moving the valve piston shaft 102 in an inward direction toward valve housing 104. If there is insufficient torque due to inadequate weight of the container 106, roller 88 and control arm 90 to cause the valve piston to be again seated (countering the water pressure of the flow) within valve housing 104 terminating the flow of the liquid into dispensing tube 30, it will then be necessary for the operator to place a small weighted object(s) into the internal compartment 108 of the container 106 in order to increase the torque sufficiently to result in the inward movement of the valve piston shaft 102 and seating of the valve piston. Small weighted objects might comprise metallic washers, metallic bolts and nuts and even rocks.

The present invention may be embodied in other specific forms without departing from the essential attributes thereof. Reference should be made to the appending claims rather than the foregoing specification as indicating the scope of the invention.

What is claimed is:

1. An air conditioner cooling apparatus designed to be used in conjunction with a cabinet air conditioner that has an air exhaust portal which has an exhaust airflow path and a length of condenser coils, said apparatus comprising:

a paddle adapted to be located within the exhaust airflow path;

a normally closed water supply valve which is connected to a source of pressurized water, opening of said water supply valve causes water to be supplied to a series of discharge nozzles through which water is to be dispensed onto the condenser coils;

a control arm connected to said valve and extending therefrom, movement of said control arm from a lower position to an upper position will cause said valve to move from a closed position to an open position permitting flow of water to said discharge nozzles;

a linkage assembly connecting said paddle to said control arm;

whereby said paddle is to be moved by the exhaust airflow path which will cause said control arm to be moved by said linkage assembly from said lower position to said upper position; and said linkage assembly including a roller, said roller being mounted on said control arm, a cam connecting with said roller, said cam riding on said roller to cause movement of said control arm from said lower position to said upper position.

2. The air conditioner cooling apparatus as defined in claim 1 wherein:

said roller being adjustable in position by raising or lowering of said roller relative to said control arm in order to individually design said cooling apparatus for the particular type of air conditioner.

3. An air conditioner cooling apparatus designed to be used in conjunction with a cabinet air conditioner that has an air exhaust portal which has an exhaust airflow path and a length of condenser coils, said apparatus comprising:

a paddle adapted to be located within the exhaust airflow path;

a normally closed water supply valve which is connected to a source of pressurized water, opening of said water supply valve causes water to be supplied to a series of discharge nozzles through which water is to be dispensed onto the condenser coils;

a control arm connected to said valve and extending therefrom, movement of said control arm from a lower position to an upper position will cause said valve to move from a closed position to an open position permitting flow of water to said discharge nozzles;

a linkage assembly connecting said paddle to said control arm;

whereby said paddle is to be moved by the exhaust airflow path which will cause said control arm to be moved by said linkage assembly from said lower position to said upper position; and said control arm including a weight assembly, said weight assembly to be adjusted on said control arm in order to vary the amount of force being applied to maintain said valve in said closed position.

4. The air conditioner cooling apparatus as defined in claim 3 wherein:

said weight assembly being adjusted by increasing or decreasing the spacing of said weight assembly relative to said valve.

5. The air conditioning cooling apparatus as defined in claim 3 wherein:

said control arm having a container mounted thereon, said container having an interior compartment adapted to receive one or more of small weighted objects.

* * * * *